United States Patent [19]

McDermid

[11] Patent Number: 4,852,322

[45] Date of Patent: Aug. 1, 1989

[54] WOODEN I-BEAM WITH INTEGRATED INSULATING FOAM

[75] Inventor: Dicky W. McDermid, Nanoose Bay, Canada

[73] Assignee: West-Isle Industries Inc., Canada

[21] Appl. No.: 240,037

[22] Filed: Sep. 2, 1988

[30] Foreign Application Priority Data

Sep. 4, 1987 [CA] Canada ..... 546236

[51] Int. Cl.[4] ..... E04C 3/29

[52] U.S. Cl. ..... 52/404; 52/690; 52/729

[58] Field of Search ..... 52/729, 730, 690, 642, 52/404

[56] References Cited

U.S. PATENT DOCUMENTS

| | | | |
|---|---|---|---|
| 1,377,891 | 5/1921 | Knight . | |
| 3,490,188 | 1/1970 | Troutner | 52/644 |
| 4,191,000 | 3/1980 | Henderson | 52/729 |
| 4,195,462 | 4/1980 | Keller et al. | 52/690 |
| 4,336,678 | 6/1982 | Peters | 52/729 |
| 4,413,459 | 11/1983 | Lambuth | 52/729 |
| 4,677,806 | 7/1987 | Tuomi | 52/729 |

FOREIGN PATENT DOCUMENTS 8100585 3/1981 World Int. Prop. O. .

*Primary Examiner*—John E. Murtagh
*Assistant Examiner*—Michele A. Van Patten
*Attorney, Agent, or Firm*—Ward Brown; Robert W. Beach

[57] ABSTRACT

Two elongated parallel rails have facing surfaces each with a longitudinally extending central groove opening toward the groove of the other rail. A rigid web sheet has its opposite longitudinal margins fitted in the grooves so as to form, in combination with the rails, a composite I-beam construction. Block units of a thickness approximately the same as the thickness of each rail are secured between the rails at opposite ends of the web sheet. Blocks of insulating foam fill the cavities at opposite sides of the web sheet.

4 Claims, 2 Drawing Sheets

WOODEN I-BEAM WITH INTEGRATED INSULATING FOAM

BACKGROUND OF THE INVENTION

1. Field of the Invention

The present invention relates to wooden structural members. More specifically, the present invention relates to a fabricated composite structural member including two parallel wooden rails having wood and foam spacing elements between them for use in building construction either as a beam or vertical wall stud.

2. Prior Art

Known building structural members include I-beams with metal webs, or with wood or laminated wooden webs. Various types of foam have been used for insulation.

Patent Cooperation Treaty publication No. WO 81/00585 discloses a girder with two parallel wood beams joined by a spacing element of polyurethane foam. The foam binds the two beams together, but separated by a distance which is adapted to the desired depth for the web of the girder.

Various wooden I-beam structures are also known in which a structural member has parallel wooden beams joined by a wooden web, such as those disclosed in U.S. Pat. Nos. 1,377,891; 4,336,678; 3,490,188; 4,195,462 and 4,191,000. The advantage of such structures is that they provide the structural strength of solid lumber while utilizing smaller dimensions of wood, thus conserving valuable wood supplies. Such I-beam structures may be used, for example, in frame house construction.

None of the known I-beam structures have contemplated the use of polyurethane foam to increase the structural strength of the structural member in addition to adding valuable insulating properties.

SUMMARY OF THE INVENTION

The present invention provides an I-beam structural member which incorporates expanded polyurethane foam fillers. Two parallel wood beams or rails are joined by a central wood web and are reinforced at spaced locations with wood spacers. The spaces or cavities thereby created in the I-beam skeleton on both sides of the central web are filled by one or more blocks of expanded polyurethane foam which are secured in position by adhesive.

DETAILED DESCRIPTION

Figure 1:
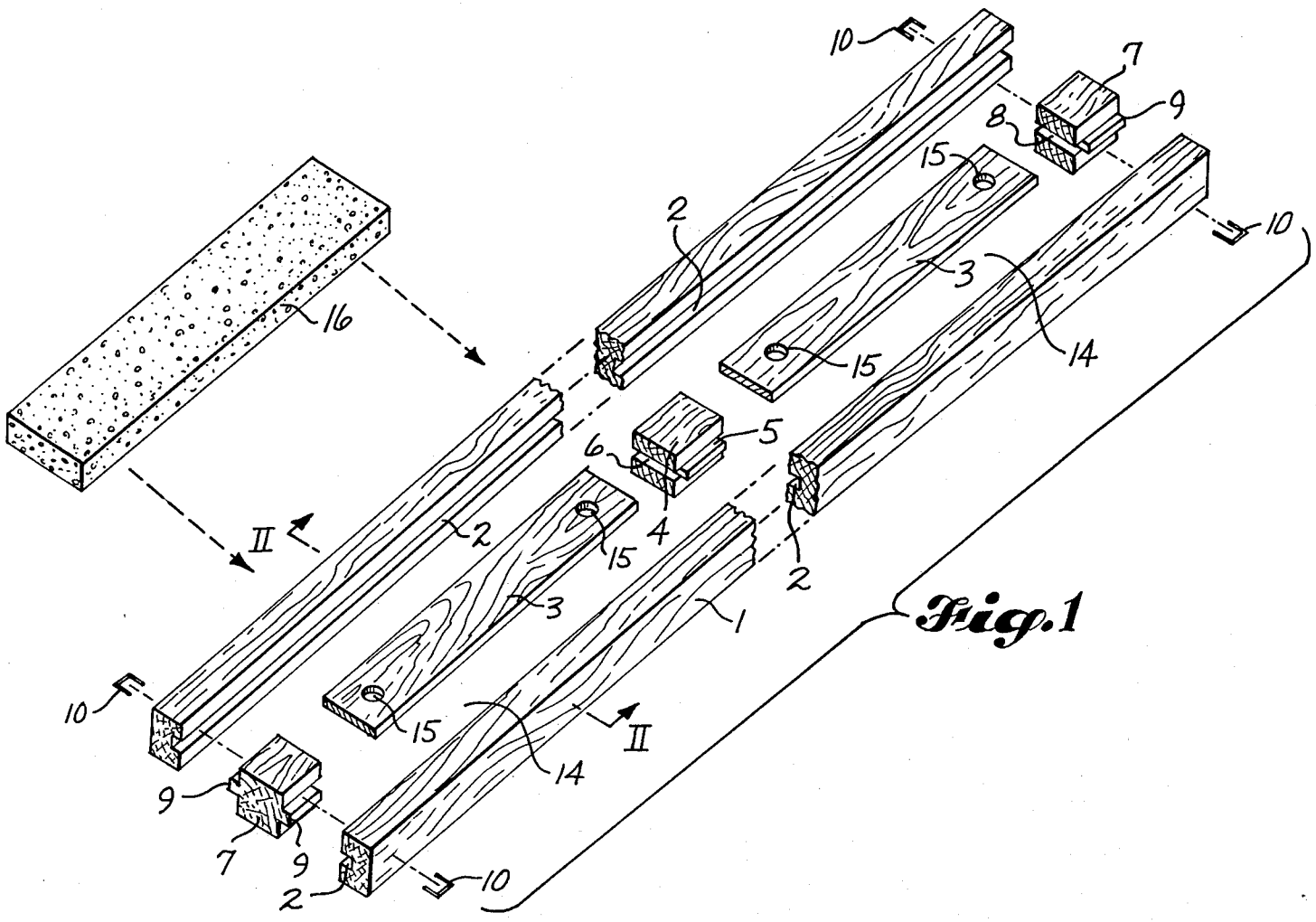
FIG. 1 is a top perspective of a structural member in accordance with the invention with parts shown in exploded relationship.
Figure 2:
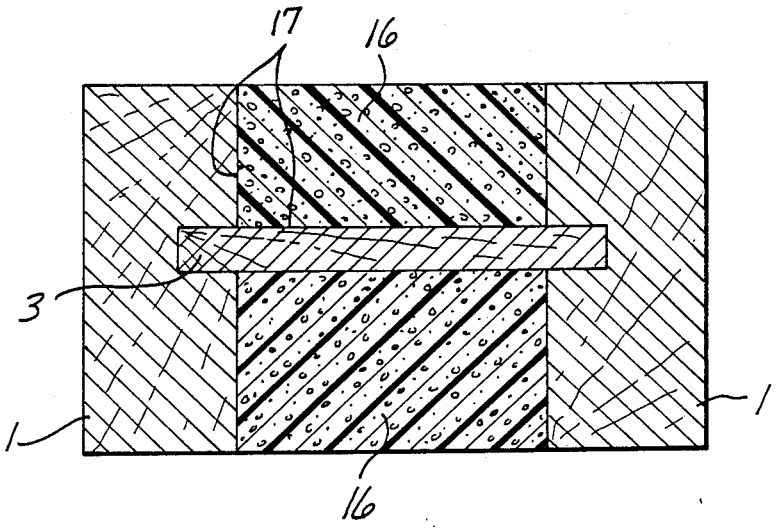
FIG. 2 is a transverse section along line II—II of FIG. 1 with the parts assembled.

Referring to FIGS. 1 and 2, the structural member in accordance with the present invention has two elongated parallel beams or side rails 1, preferably wood, with spacing elements between them. The inside face of each rail has a longitudinally extending groove 2 opening toward the other rail. Wood spacing elements in the form of elongated rigid sheets 3 of plywood or particleboard, for example, have their opposite longitudinal margins snugly received in the rail grooves 2. A central or intermediate block unit 4 of approximately the same height as the rails 1 has oppositely projecting tongues 5 received in the rail grooves 2 and end grooves 6 registered with the rail grooves to receive the adjacent end margins of the spacing elements or sheets 3.

At each end of the beam there is an end block or filler unit approximately the same height as the rails 1 with oppositely projecting tongues 9 snugly received in the rail grooves 2. Each end block or filler has a slot 8 only in one end, in each instance the inward-facing end, registered with the rail grooves 2 to receive the end margin of the corresponding spacer element or sheet 3 opposite its end received in the central or intermediate block unit 4. Preferably, all of the interlocking tongues and grooves are positioned approximately midway between the top and bottom longitudinal edges of the rails 1. The interlocking spacer elements or sheets 3 approximately bisect the rails to form the web of the composite I-beam skeleton. All interlocking joints can be secured with glue or adhesive. At each end of the structural member, staples 10 can be driven laterally through the rails into the end block or filler unit 7, preferably at a location registered with the rail grooves 2. For extra strength and to avoid problems with shrinking, the grain of each of the wooden end block unit and the intermediate block unit should run parallel to the grain of the side rails, preferably longitudinally of the structural member.

When the structural member skeleton as thus far described has been assembled, there are four rectangular cavities 14, one toward each end of each side of the member. Each cavity is open at the outside, but is otherwise fully enclosed by the parallel rails 1, the intermediate block unit 4, an end block or filler unit 7 and the spacer sheet or web 3. Each cavity is filled with a block 16 of insulating expanded polyurethane foam which is secured and strengthened in position by glue or other adhesive substance on surfaces 17, as indicated in FIG. 2, so as to form completely integrated components of the structural member. The exposed faces of the foam blocks are flush with the opposite longitudinal edges of the rails 1. The wooden web sheets 3 can be predrilled to have holes 15 for the purposes of wiring, plumbing, etc.

The composite structural member can be used as a building stud to replace solid 2"×4", 2"×6" or 2"×8" lumber in frame house construction. The resultant stud has insulating properties which are superior to those of solid lumber or prior art I-beams by virtue of the integrated expanded polyurethane foam. Further, the construction causes the overall strength of the composite structural member to be superior to both prior art I-beams and solid lumber.

I claim:

1. A composite structural beam or stud for use in construction comprising:

(a) two parallel wooden rails each having a groove midway on the inside face of the rail and extending longitudinally for the length of the rail such that the groove on each rail is opposite the groove on the other rail;

(b) two rectangular pieces of wooden web, one piece located in the upper end of the beam and the other in the lower end, each slotting into the grooves on the inside facing sides of the parallel rails;

(c) two wooden blocks, arranged with one at each end of the beam, each having transverse tongues, located one on each side, opposite to the grooves in the wooden rails, and each having a transverse groove located midway on the inward facing end of each block opposite the grooves in the chords and the pieces of wooden web;

(d) one wooden block positioned in the middle of the beam and having transverse tongues, located midway one on each side, opposite to the grooves in the wooden rails, and having transverse grooves located midway on the ends facing longitudinally along the beam and opposite to the pieces of wooden web; and (e) blocks of insulating foam secured in and filling the cavities formed upon the assembly of the side rails, webs and blocks.

2. The beam or stud defined in claim 1, wherein said blocks of insulating foam are secured by an adhesive to the surfaces of said rails, webs and blocks.

3. The beam or stud defined in claim 2, wherein the grain of said wooden blocks runs parallel to the grain of said wooden rails.

4. A composite structural member comprising two parallel rails having facing surfaces, each of said facing surfaces having an elongated groove opening toward the corresponding groove of the other rail and aligned therewith, an elongated web of rigid sheet material having its opposite longitudinal margins fitted, respectively, in said grooves and of a width to space said rails apart a desired distance, two block units fitted and secured between said rails at opposite ends of said web so as to form a cavity bounded by said web, said rails and said block units, and a block of insulating foam material secured in and substantially filling said cavity.

* * * * *